United States Patent [19]

Glassman et al.

[11] Patent Number: 4,742,590

[45] Date of Patent: May 10, 1988

[54] BRIDGING KIT

[75] Inventors: Ami Glassman; Shelomo Yechiely, both of Haifa, Israel

[73] Assignee: The State of Israel, Ministry of Defense, Israel Military Industry, Israel

[21] Appl. No.: 889,202

[22] Filed: Jul. 25, 1986

[30] Foreign Application Priority Data

Sep. 24, 1985 [IL] Israel ..... 76487

[51] Int. Cl.[4] ..... E01D 21/00

[52] U.S. Cl. ..... 14/1; 14/27

[58] Field of Search ..... 14/1, 2.4, 2.6, 27, 14/69.5, 71.1, 72.5

[56] References Cited

U.S. PATENT DOCUMENTS

| | | | |
|---|---|---|---|
| 648,620 | 5/1900 | Holmes | 14/72.5 X |
| 1,279,097 | 9/1918 | Fredeen | 14/27 |
| 3,397,546 | 8/1968 | Eisert et al. | 14/2.4 X |
| 3,499,179 | 3/1970 | Weld | 14/27 |
| 3,744,075 | 7/1973 | Zaremba | 14/1 |
| 4,297,759 | 11/1981 | Soffge et al. | 14/2.6 |
| 4,675,931 | 6/1987 | Quint | 14/71.1 |

OTHER PUBLICATIONS

Popular Mechanics, Feb. 1942 issue, p. 54.

*Primary Examiner*—James A. Leppink
*Assistant Examiner*—Matthew Smith
*Attorney, Agent, or Firm*—Steinberg & Raskin

[57] ABSTRACT

A bridging set for use by infantry personnel for the passage of water obstacles. The set comprises at least one bridge unit, a float adapted for connection to a bridge unit from below and a roller unit adapted to support loosely a bridge unit. The bridge units are adapted for fast-locking coupling in alignment so as to form an extended bridge assembly. With the aid of the float and roller, a bridging unit or an assembly of such units is advanced from one bank of a water obstacle to the other.

3 Claims, 4 Drawing Sheets

BRIDGING KIT

BACKGROUND OF THE INVENTION

The present invention concerns a bridging set for use by infantry personnel for the passage of water obstacles.

In combat, it happens that advancing infantry troops have to cross a water obstacle such as a narrow river, ravine, a canal and the like without being able to wait for the engineers to construct a proper bridge. The present invention aims at providing a solution for this problem.

GENERAL DESCRIPTION OF THE INVENTION

In accordance with the present invention, there is provided a bridging set comprising at least one bridge unit, a float support adapted for connection to a bridge unit from below and a roller unit adapted to support loosely a bridge unit.

Preferably, a bridging set according to the invention will comprise a plurality of bridge units adapted for connection in alignment in order to provide a bridge assembly of sufficient length to span the water obstacle that is to be bridged.

For deployment, an end portion of a bridge unit or bridge assembly comprising a plurality of such units is mounted on a float support by connecting the float support from below, and the float support with the end portion of the bridge unit or assembly mounted thereon is then inserted into the water. Thereupon a portion of the bridge unit or assembly that is spaced from the front end is loosely mounted on the roller unit following which the bridge unit or assembly is gradually pushed forward until the floating front end reaches the opposite bank.

The advancement of the bridge from one bank of a water obstacle to the opposite bank can be controlled in various simple ways. For example, the operators may simply hold the bridge assembly and push it forward carefully and in a controlled manner; or in case of a strong downstream pull, a rope may be connected to the front end of the bridge and be gradually released; and the like.

BRIEF DESCRIPTION OF THE DRAWINGS

Some preferred embodiments of the invention will now be described with reference to the attached drawings in which.

DESCRIPTION OF A PREFERRED EMBODIMENT

Figure 1:
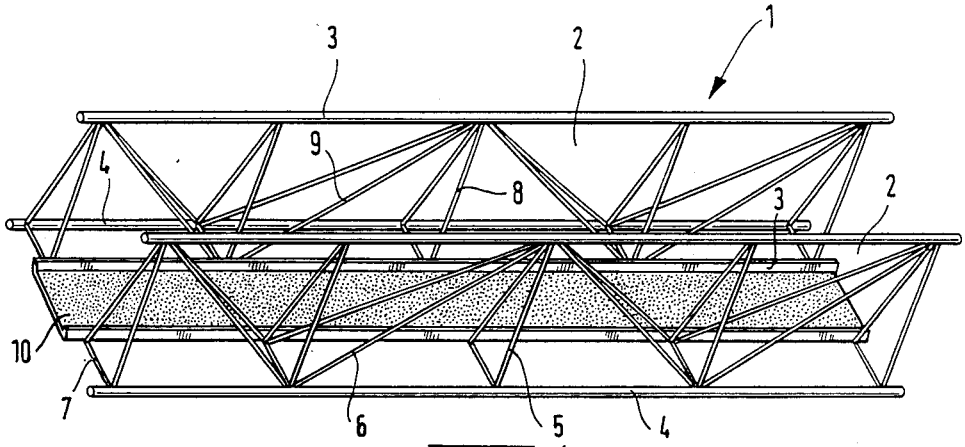
FIG. 1 is a perspective view of a bridge unit of a set according to the invention.

The bridge unit 1 shown in FIG. 1 is preferably made of a light metal such as aluminum and comprises two railings 2 each having an upper longitudinal bar 3 and a lower longitudinal bar 4 held together by a plurality of struts such as struts 5 and 6. The two railings 2 are interconnected by crossbars 7 which are also linked to the upper longitudinal bars 3 by means of struts such as struts 8 and 9.

Resting on crossbars 7 is an oblong bottom plate 10.

Figure 2:
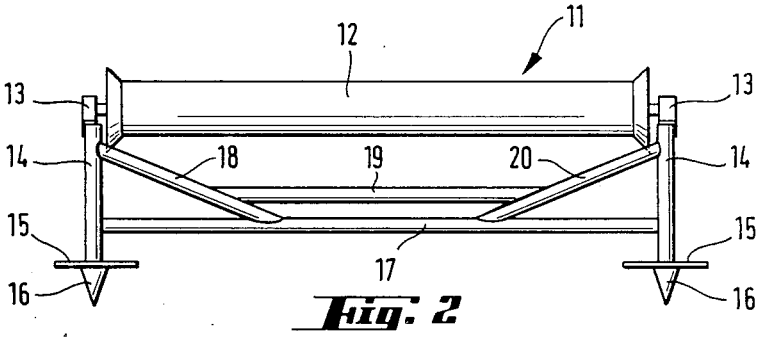
FIG. 2 is an elevation of a roller unit of a set according to the invention.

The roller unit 11 shown in FIG. 2 comprises a roller 12 journalled in bearings 13 supported in a frame including two pairs of spread legs 14 each fitted with a bottom plate 15 and a pointed wedge member 16. The two pairs of legs 14 are linked by a crossbar 17 engaging two lateral struts 21 (see FIG. 8), the roller unit structure being further reinforced by struts 18, 19 and 20.

Figure 3:
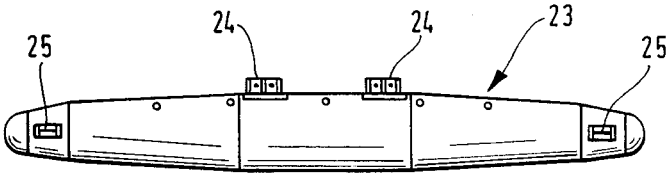
FIG. 3 is an elevation of a float support of a set according to the invention.

The float support 23 shown in FIG. 3 is of a cigar-like shape designed to minimize the hydrodynamic resistance in axial direction. It comprises two pairs of lugs 24 adapted for cooperation with a crossbar 7 of a bridge unit 1. The float support 23 further comprises closures 25 which may be opened for the withdrawal of any water that has penetrated into the float.

Figure 4:
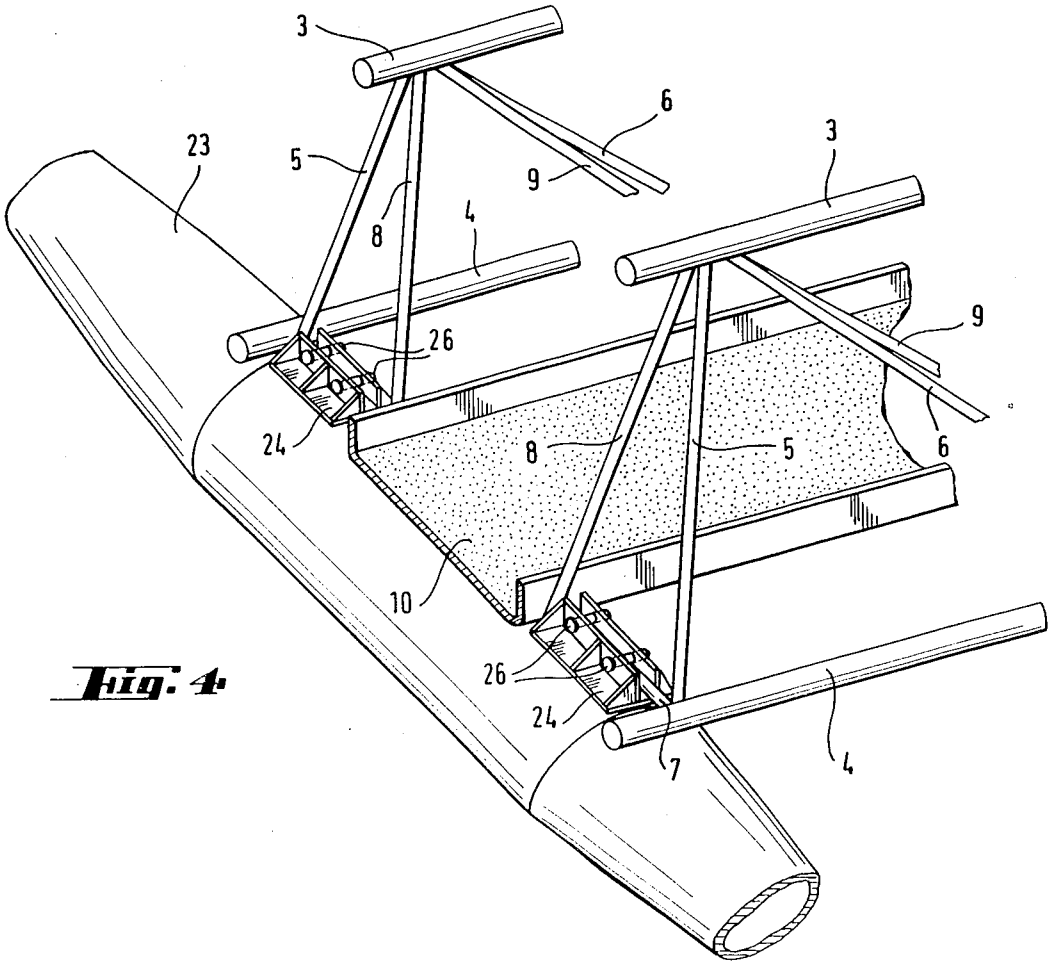
FIG. 4 is a detail perspective view showing a connection between a bridge unit and float support.

The connection of float support 23 to a bridge unit 1 is shown in FIG. 4. As shown, a terminal crossbar 7 is gripped by the two pairs of lugs 24 and locked from above by locking pins 26.

As a rule, a bridging set according to the invention will comprise a plurality of bridge units 1 which have to be adapted for fast-locking coupling. For this purpose, one end of each of the longitudinal bars 3 and 4 will be designed as a mail component and the opposite end as a female component of a coupling arrangement which also comprises locking means. Such an arrangement which is of the eccenter type, is shown, by way of example, in FIGS. 5–7. As shown, a longitudinal bar 4' of one bridging unit is coupled to a longitudinal bar 4'' of another, aligned bridging unit. The righthand side end of bar 4' is designed a female coupling member while the lefthand side end of bar 4'' is designed a male coupling member. Bar 4'' comprises a catch member 28 swingably mounted on an axle together with a handle 30 being integral with an eccenter 29, the arrangement being such that when the handle 30 is turned clockwise while catch member 28 is in the lower, engaging position, eccenter 29 pulls the catch to the right (with reference to FIGS. 5–7). The depending lateral walls of catch member 28 are hook-shaped and adapted to engage lateral studs 31. On the righthand side bar 4'', there is provided a resilient catch for handle 30.

Figure 5:
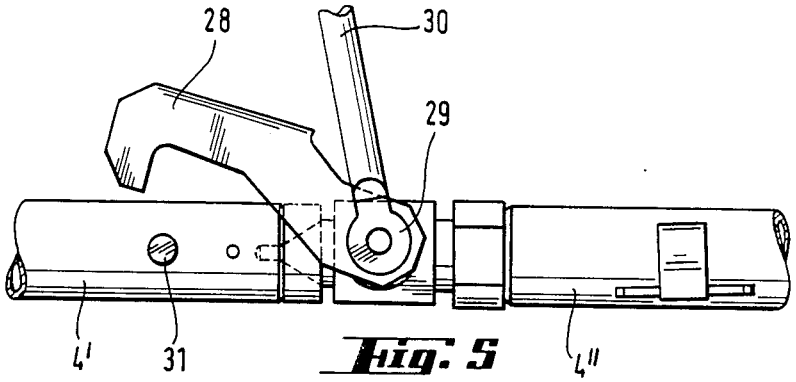
FIGS. 5–7 show coupling locks for coupling together two bridge units of a set according to the invention.
Figure 6:
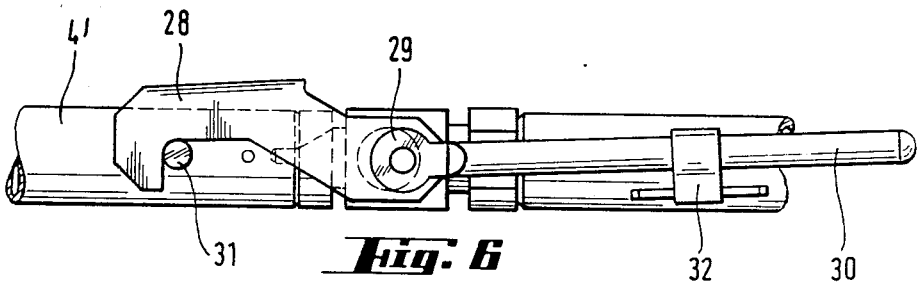
Figure 7:
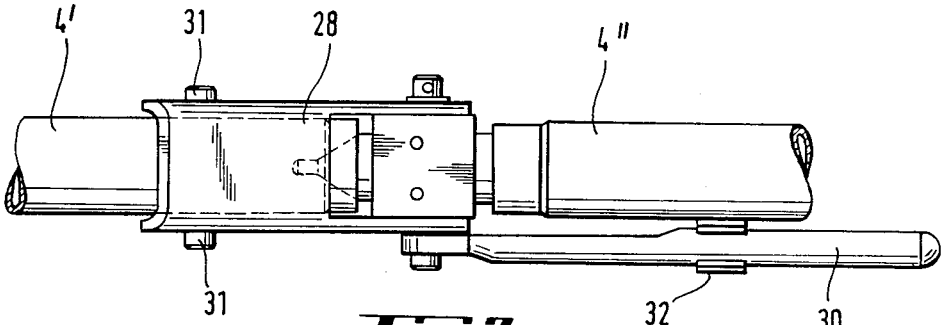

For coupling two bridge units 1, the male component of bar 4'' is inserted into the female component of bar 4' as shown in FIG. 5. Thereafter, the catch member 28 is lowered into engagement with studs 31 and subsequently handle 30 is turned clockwise whereby the eccenter 29 pulls the catch member 28 from left to right whereby the two bars 4' and 4'' are firmly coupled as shown in FIGS. 6 and 7. In this locking state, handle 30 is received and held by catch 32.

Similar coupling means will be provided for the upper longitudinal bars 3 and it is thus seen how a plurality of modular bridge units 1 may be coupled in alignment with fast locking, in order to provide a bridge assembly of adequate length.

Figure 8:
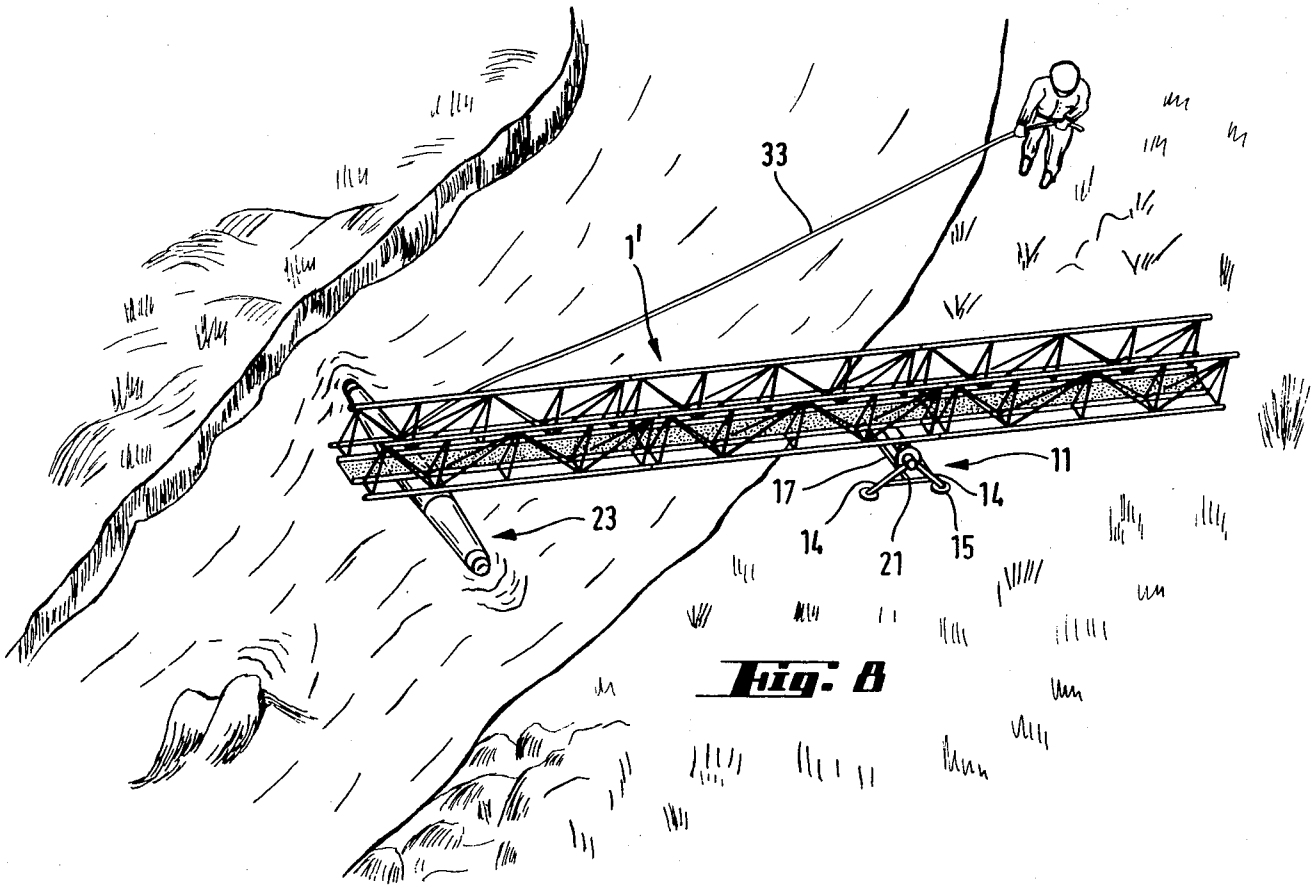
FIG. 8 is a perspective view showing a bridge assembled from a set according to the invention in the course of deployment.

FIG. 8 shows how a ravine is bridged in accordance with the present invention with prevention of downstream diversion. As shown, the front end of a bridge assembly 1' consisting of a plurality of bridge units 1 of the kind shown in FIG. 1 coupled together in the manner explained with reference to FIGS. 5 to 7 is mounted on a float support 23 of the kind shown in FIG. 3 in the manner explained with reference to FIG. 4. The land borne portion of the bridge assembly 1′ is supported by a roller unit 11 of the kind shown in FIG. 2 and an operator controls the movement of the front end of the bridge assembly 1′ by means of a rope 33.

We claim:

1. A method for installing a bridge including at least one bridge unit to span a water obstacle overhead thereof, said bridge to extend from a first bank of the water obstacle to a second bank thereof, comprising the steps of:

connecting a float to an underside of a forward end portion of said at least one bridge unit;

fixedly positioning a roller unit on said first bank of the water obstacle, said roller unit including at least one roller mounted in a frame;

inserting said float and forward end portion of said at least one bridge unit to which it is connected into the water so that said forward end portion of said one bridge is floatingly supported on the water by said float;

placing a portion of said at least one bridge unit which is spaced from said forward end portion thereof onto said roller of said roller unit which is fixed on said first bank; and advancing said at least one bridge unit until the floating forward end portion thereof reaches said second bank.

2. The method of claim 1 including the further step of, after placing a portion of said at least one bridge unit onto said roller of said roller unit, holding said at least one bridge unit and urging it forwardly to control the advancement of said at least one bridge unit.

3. The method of claim 2 wherein said controlled advancement comprises, in the case of a downstream current, connecting one end of a rope or the like to the forward end portion of said at least one bridge unit and gradually releasing the rope from the first bank as the at least one bridge unit is advanced to control the direction of advancement of said least one bridge unit.

* * * * *